United States Patent [19]

Chang

[11] Patent Number: 4,682,738

[45] Date of Patent: Jul. 28, 1987

[54] GRINDING MILL

[76] Inventor: Shien F. Chang, 350 Fifth Ave., Ste. 2822, New York, N.Y. 10118

[21] Appl. No.: 799,904

[22] Filed: Nov. 20, 1985

[51] Int. Cl.[4] ..... B02C 23/28

[52] U.S. Cl. ..... 241/56; 241/79.1; 241/129

[58] Field of Search ..... 241/56, 79.1, 80, 97, 241/109, 114, 119, 59, 110, 124–133

[56] References Cited

U.S. PATENT DOCUMENTS 3,955,766 5/1976 Chang .

*Primary Examiner*—Mark Rosenbaum

*Attorney, Agent, or Firm*—Hedman, Gibson, Costigan & Hoare

[57] ABSTRACT

A centrifugal grinding mill of the ring-roller type incorporating a decelerating means, a grinding roller means, a classifying means and a finished product conveying means, which means are driven by a single shaft driven by a single motor, is suitable for grinding soft, hard and solid (ores), viscous, and fibrous raw materials to desired fineness. The distance between grinding ring and rollers is adjustable. Under the grinding roller means there is provided a means for removing waste materials. By means of the guiding of an air stream in cooperation with the classifying means the separate vanes of which can be selectively changed in number, it is possible to obtain finished particles ranging in size from several ten to more than ten thousand mesh (U.S. standard mesh).

16 Claims, 14 Drawing Figures

GRINDING MILL

BACKGROUND OF INVENTION

The present invention relates to grinding mills, and particularly to a centrifugal ring-roller mill incorporating in the mill cylinder a decelerating means, a grinding roller means, a classifying means and a finished product conveying means. A motor drives the said means by a single shaft. This mill is suitable solid ores that are soft or hard viscous, and fibrous raw materials to the desired fineness.

Typical of known roller mills is the Raymond ring-roller mill, which is vertically mounted and contains therein a centrifugal grinding roller device and a fixed separator. The grinding roller device is operated by a drive means mounted outside the mill through a speed reducing means, drive means, and a horizontal drive shaft. A blower, also mounted outside the mill, is used for creating an upward air stream in the mill to sweep finely ground material or particles through the fixed separate vanes of the separator into a discharge pipe. Such a mill is rather complicated in construction and difficult to maintain and repair. It also occupies a large space, and requires high power. In operation the mill presents further problems such as vibration, noise, and dust clouds. Moreover, as far as grinding efficiency is concerned, particles finer than 300 U.S. standard mesh can hardly be produced, and grinding fibrous and viscous raw materials can be difficult.

In order to overcome the above disadvantages, the inventor provided an improved roller mill, that is described in U.S. Pat. No. 3,955,766. Mounted in ascending order in this roller mill are a speed reducer device, a centrifugal grinding roller device, a classifier device and dust collector device. All the devices are driven by a single vertical shaft that is driven by an electric motor mounted on top of the mill so as to obviate the need for a drive means, driven means and blower located outside the mill. This not only renders the mill simple in construction and compact in size, but can also increase grinding efficiency. Furthermore, the roller mill is suitable for grinding various raw materials including solid, fibrous, and viscous materials, with the finished particles being finer than 1,000 mesh.

While that roller mill enjoys several advantages over the previously described ring-roller mill, the inventor has performed subsequent experiments and has found that although there is no denying the fact that using centrifugal force resulting from rotating rollers as the grinding force yields positive grinding effects, the centrifugal force varies in accordance with the rotational speed and weight of the rollers and thus may result in different grinding forces. Under normal low-speed operating conditions, the rollers will not cause any problem. However, if the rotational speed of the rollers is increased in order to facilitate grinding of the raw materials or to obtain greater capacity or output, an excessively high grinding pressure results from the increased centrifugal force due to the increase in rotational speed of the rollers. The excessively high grinding pressure tends to compress part of the ground fine particles into flakes which may adhere to the grinding ring and the peripheral wall of the rollers or drop down on the bottom of the mill instead of being carried in an air stream to the classifier. Also, the excessively high grinding pressure often gives rise to great vibration, noise, and wear of the rollers and the grinding ring by subjecting both to crushing and friction. In addition, since in there is no clearance between the centrifugal rollers and the grinding ring and relatively high power is required to start operation due to the great friction and vibration at the time of actuation. Especially, in case of an unexpected loss of power during operation, it will be extremely difficult to re-start the rollers after the power supply resumes unless the raw material already fed into the mill has been cleared away, since the internal working parts of the mill are fully loaded. In addition, since the aforesaid rollers are each held in suspension by a support arm, when the rollers need repairing or replacing due to wear, the support arm and the shaft of the associated roller must be disassembled as a whole so that roller can be removed, thus inconveniencing maintenance and repair work. Further, the support arm occupies so large a space that not only is the effective working space in the separation chamber diminished, but the support arm, when rotating, also hinders the formation of an upwardly spiralling flow of ground particles and air below it to such an extent that the particles come together and cause the grinder to become plugged.

SUMMARY OF INVENTION

The main object of the present invention is to eliminate the above-mentioned disadvantages by providing a vertical centrifugal ring-roller mill comprising a decelerating means, a grinding roller means, means for adjusting the clearance between grinding ring and rollers, a classifying means and a finished product conveying means, all being mounted within the mill cylinder and driven by a single motor and vertical main shaft extending along the axis of the mill cylinder.

Another object of the present invention is to provide a grinding-mill which is simple in construction compact in size, occupies a small mounting area, requires low power, starts easily, and creates a minimum of noise and vibration.

A further object of the present invention is to provide a grinding mill in which the main transmission mechanism and grinding roller means are placed in the lower most portion of the mill cylinder and a classifying chamber is formed in the upper portion of the mill cylinder and a classifying chamber is formed in the upper portion of the mill cylidner so that the mill has a low center of gravity and smooth, uninterrupted flow of ground particles and air is ensured.

Another object of the present invention is to provide a grinding mill the rollers of which are each supported by a hinged supporting cylinder and outwardly inclined under the influence of gravity and centrifugal force, without any other mechanism above the rollers which may hinder the assembly and disassembly of the rollers or the separation of ground particles and air.

Still another object of the present invention is to provide a grinding mill in which the clearance between grinding ring and rollers can be adjusted so as to achieve optimum grinding effects and minimize the wear of working parts.

Another object of the present invention is to provide a grinding mill suitable for grinding solid (ores), fibrous-,and viscous raw materials.

Another object of the present invention is to provide a grinding mill which enables the user to grind the raw material to the desired fineness by adjusting the clearance between grinding ring and rollers while minimizing noise and vibration.

Other objects and features of the invention will be apparent from the following description with reference to the accompanying drawings, in which.

DETAILED DESCRIPTION OF PREFERRED EMBODIMENT

Figure 1:
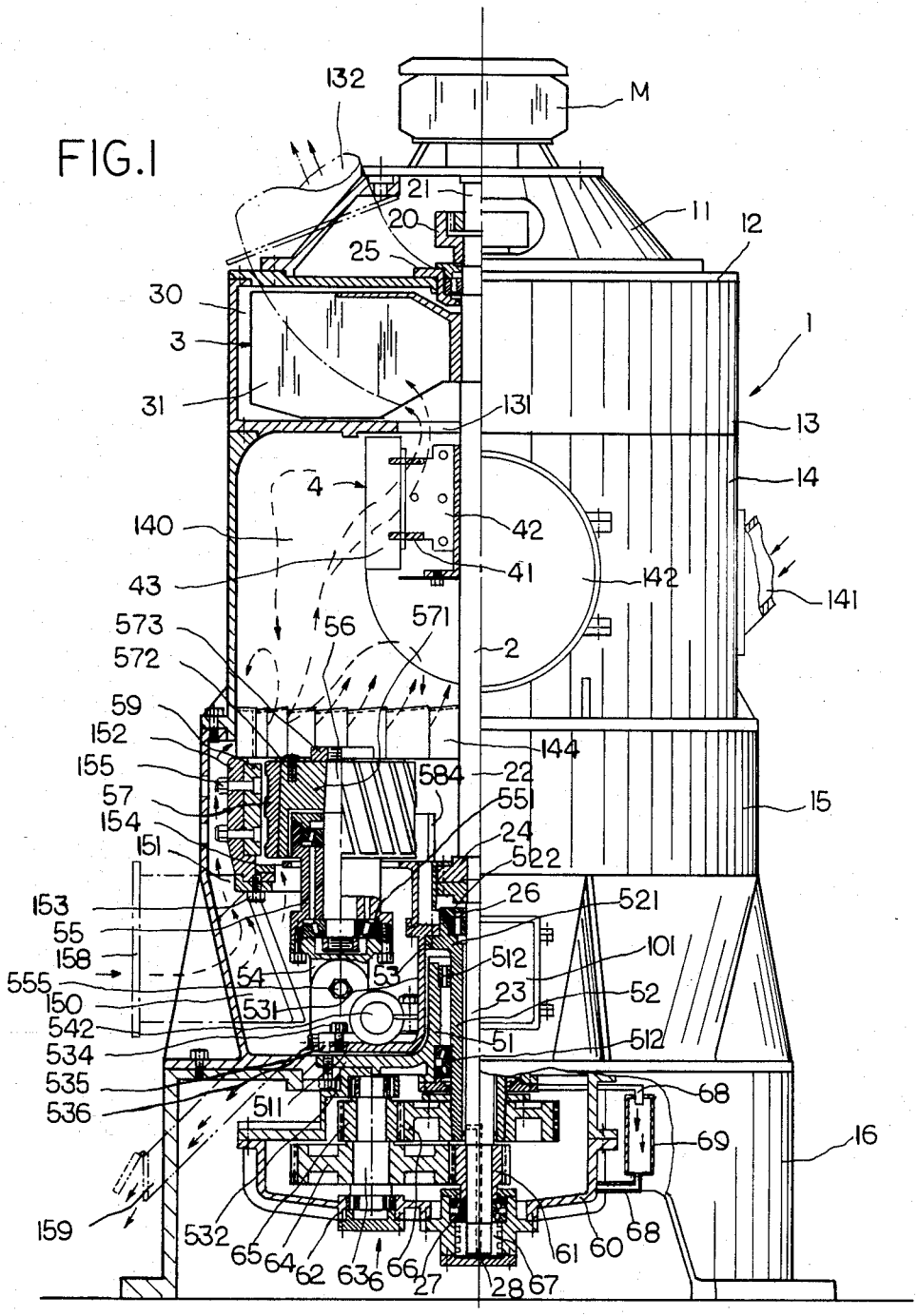
FIG. 1 is an elevational view, partly in longitudinal section, of a grinding mill according to the present invention.
Figure 2:
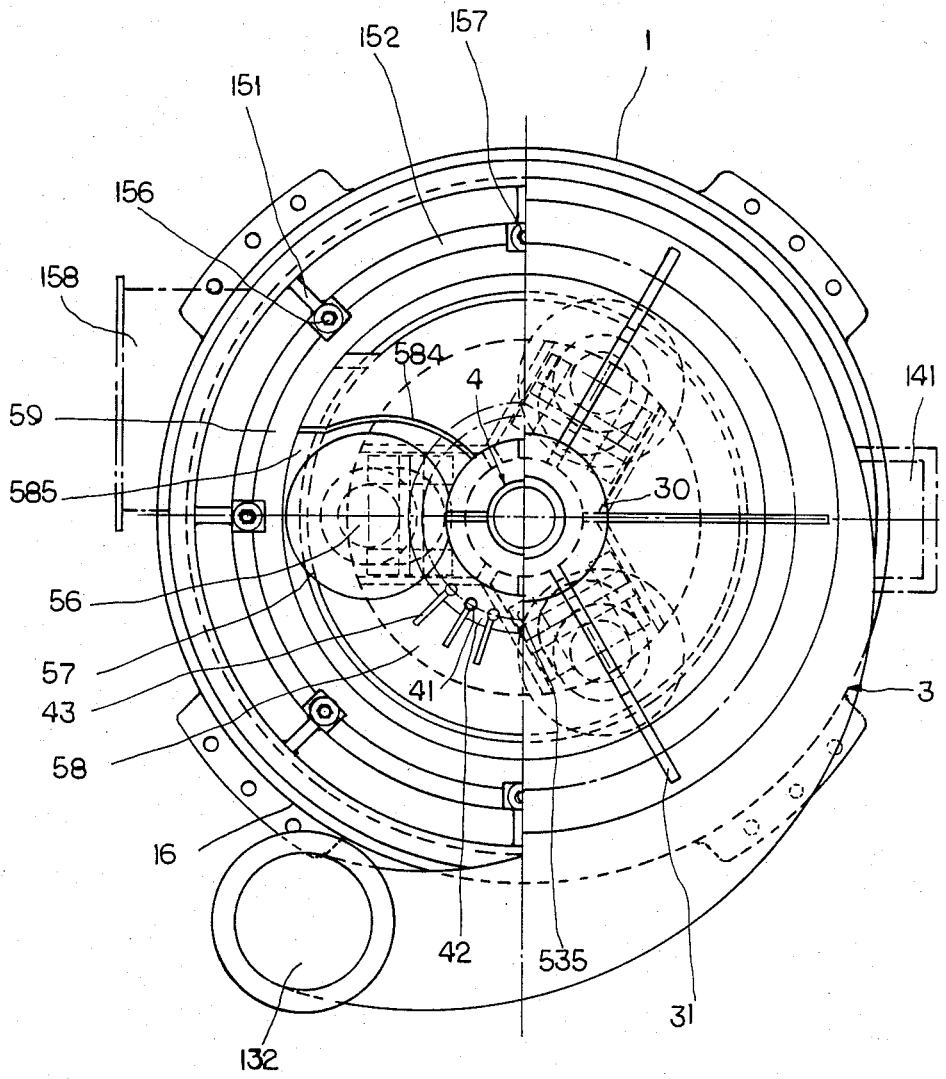
FIG. 2 is a top view, partly in corss section, of the grinding mill.

As shown in FIGS. 1 and 2, there is depicted a grinding mill 1 comprising from top to bottom a motor rest 11, a top cover 12, an upper mill cylinder 13, a central mill cylinder 14, a lower mill cylinder 15 and a mill support frame 16.

An electric motor M is mounted in upright position on the motor rest 11 at the center thereof. The shaft 21 of the motor extends downwardly to be connected by a coupling 20 to the upper end of a main shaft 2 which extends vertically along the axis of the grinding mill cylinder 1. For the purposes of easy manufacture and installation, the main shaft 2 is made in two sections, i.e., an upper shaft section 22 and a lower shaft section 23, joined together by a coupling 24. The upper shaft section 22 is supported at the upper end by thrust bearing 25 provided at the center of the top cover 12, while the lower shaft section 23 is supported at opposite ends by thrust bearings 26 and 27 which are provided, respectively, at the upper end of a rotary bushing 52 which will be described herein and at the lower end of a gear box 60 located under the lower mill cylinder 15 within the mill support frame 16. The lower end of the lower shaft section 23 extends through the bottom end of the lower mill cylinder 15 into the gear box 60.

Mounted in descending order on the main shaft 2 are a finished product conveying means 3, a classifying means 4, a grinding roller means 5 (FIG. 3) and a decelerating means 6, all being driven by the main shaft 2.

The finished product conveying means 3 is located within the upper mill cylinder 13 and comprises a fan 30 composed of a plurality of vanes 31 and coupled to the main shaft 2. The upper mill cylinder 13 has at the bottom an inlet 131 for the passage of finished product and air and a voluted exhaust pipe 132 extending outwardly and upwardly from the rear of the upper mill cylinder, so that the fan 30 and the upper mill cylinder may function as a blower for sucking and discharging the finished product within the mill cylinder 1.

The classifying means 4 is located in the upper part of the central mill cylinder 14 and comprises a double-disc rotary member 42 coupled to the main shaft 2 and formed with a plurality of circumferentially spaced mounting notches 41 and a corresponding plurality of radially disposed separate blades 43 removably engaged along one side within the notches 41 in the discs of the rotary member 42. The central mill cylinder is further provided with a feed inlet 141 at one side and an inspection door 142 hinged to the front and rear sides of the central mill cylinder. The inspection doors 142 can thus serve as manholes through which the operator can get into a classifying chamber 140 for inspection, maintenance, cleaning, repair work, or assembly and disassembly of the grinding roller means and separate blades 43.

The grinding roller means 5 is mounted in the lower mill cylinder 15 enclosing a grinding chamber 150 in which grinding of raw material is carried out. The grinding roller means has a fixed sleeve 51 having a radial flange 511 whereby the sleeve 51 is fixed at the center of the base of the lower cylinder 15. The fixed sleeve 51 is provided therein with a thrust bearing 512 at opposite ends thereof. A rotary bushing 52 having a bearing 26 and a radial flange 521 on the upper end is interposed within the upper shaft section 22 and the fixed sleeve 51. The rotary bushing 52 is spaced apart from the upper shaft section 22 and is rotatable within the fixed sleeve 51 by virtue of the thrust bearings 512. The rotary bushing 52 is provided on its upper end with an annular cover 522. A roller seat 53 having an upwardly projecting central cylindrical portion 531 is loosely fitted around the fixed sleeve 51 and fastened by bolts to the upper flange 521 of the rotary bushing 52 so as to be rotatable therewith.

The roller seat 53 has a circular seat portion 532 formed with circumferentially equidistantly spaced flattened portions 533 (three such flattened portions being shown in this embodiment). A pair of spaced-apart hinge members 535 are secured by screws 534 to each flattened portion 533 of the circular seat portion 532. A roller support cylinder 54 having at the lower end a hinge portion 541 fitted between the pair of hinge members 535 on each flattened portion 533 is hinged to the circular seat portion 532 of the roller seat 53 by means of a pivot 542 extending through each pair of hinge members 535 and the hinge portion 541 so as to pivot inwardly and outwardly with respect to the axis of the upwardly projecting-central cylindrical portion 531 of the roller seat 53. Each roller support cylinder 54 is radially adjustable by means of a pair of adjusting screws 536 passing through a pair of corresponding bores 537.

A bearing sleeve 55 provided with a pair of thrust bearings 551 at opposite ends thereof is joined to the upper end of each roller support cylinder 54. A roller shaft 56 provided with a pair of thrust bearings 551 at opposite ends thereof is joined to the upper end of each roller support cylinder 54. A roller shaft 56 is rotatably interposed within the bearing sleeve 55. The grinding roller means 5 includes three grinding rollers 57, each of which fits around a roller bushing 571 is fastened to the upper end of the roller shaft 56 by a fixing nut 573. Each grinding roller 57 and roller bushing 571 are secured together by means of a face plate 572 and screws. The grinding roller 57 may be designed with various scored grinding surfaces as shown in FIGS. 5A–5D.

Figure 3:
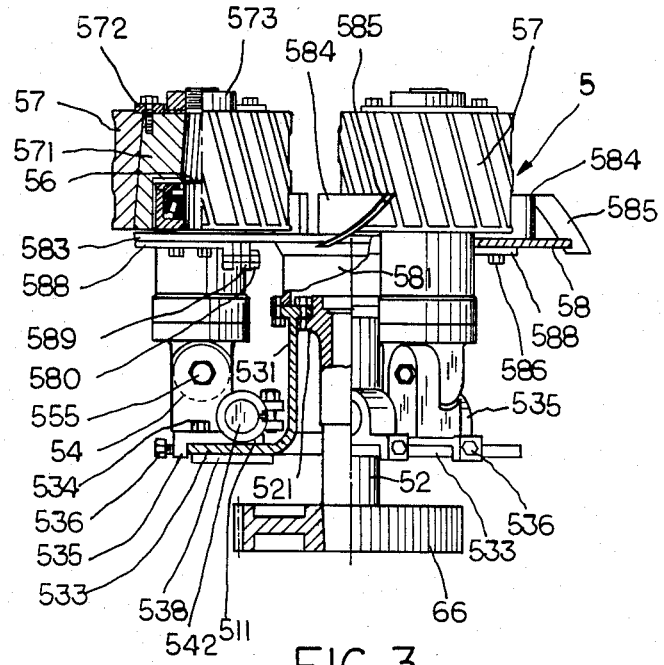
FIG. 3 is an elevational view, partly in cross section, of a grinding roller means for the mill.
Figure 4:
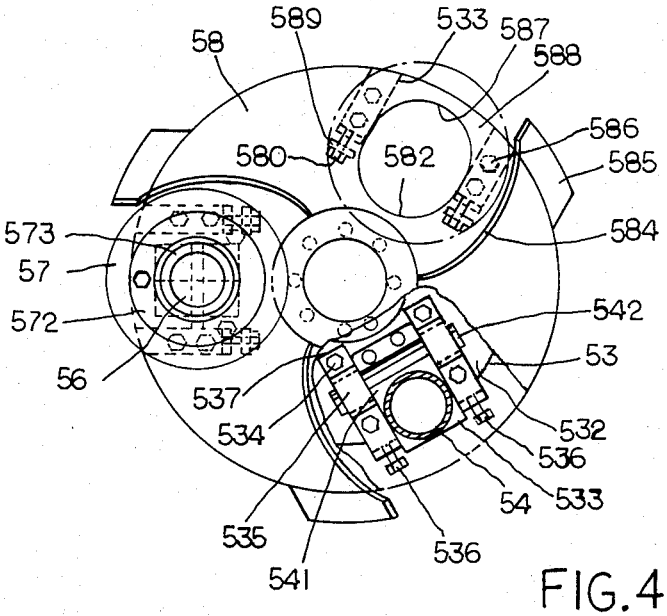
FIG. 4 is a top view, partly in cross section, of the grinding roller means shown in FIG. 3.
Figure 5:
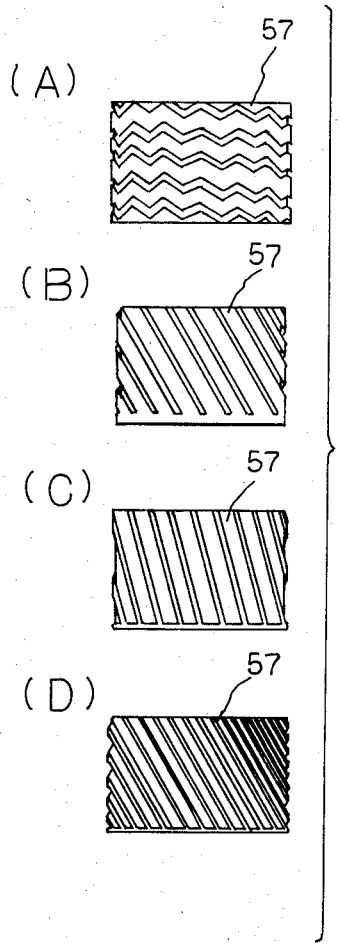
FIG. 5A–5D are elevational views illustrating different embodiments of the grinding roller of the present invention.
Figure 6:
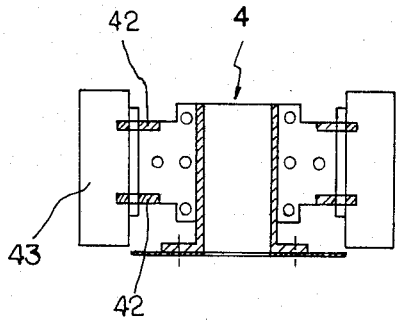
FIG. 6 is an elevational view, partly in section, of a classifying means for the grinding mill.
Figure 7:
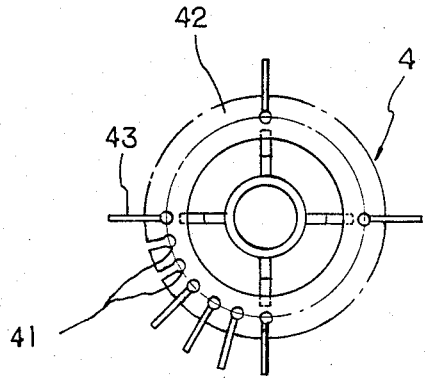
FIG. 7 is a top view of the classifying means shown in FIG. 6.

Underneath the grinding rollers 57 is a centrifugal device 58 having a circular plate 583 and downwardly protruding cylindrical portion 581 depending from the center of the circular plate 583. As best seen in FIG. 3, the circular plate 583 may be formed in its rim with a plurality of semicircular openings 582 (three openings being shown in this embodiment) and a plurality of evenly spaced spiral centrifugal vanes 584 (three in this embodiment) thereon. Fixed to the outer end of each centrifugal vane 584 is a scraper 585 inclined forward in the direction of rotation. An adjustable plate 588 having an opening 587 corresponding to the openings 582 in the circular plate 583 is attached by screws 586 to each semicircular portion 582 and can be moved relative to the roller shaft 56 by adjusting and adjusting screw 580 which is screwed into a fixing plate 589 depending from the undersurface of the of the circular plate 583. It is to be understood that by adjusting the adjustable plate 588 the angle of inclination of each roller 57 and the clearance between each roller and a grinding ring 59 which will be described later can be adjusted.

As seen in FIG. 1, an air inlet pipe 158 is provided at one side of the lower mill cylinder 15 for directing air into the grinding chamber 150. An inspection door 101 is hinged to the front and rear sides of the lower mill cylinder 15 for directing air into the grinding chamber 150. An inspection door 101 is hinged to the front and rear sides of the lower mill cylinder 15 to allow inspection, maintenance, cleaning and adjusting of the grinding roller means 5. A plurality of evenly spaced, radially extending support plates 151 protrude from the inner wall of the lower mill cylinder 15 for supporting annular grinding ring seat 152, which is secured at its base to the support plates 151 by means of screws 153. An annular liner 154 is placed on the base of the annular grinding ring seat 152 and secured in place by the said screws 153. The aforementioned grinding ring 59 is attached to the inner peripheral wall of the grinding ring seat 152 by screws 155 with a small clearance between the grinding ring 59 and the rollers 57. A plurality of retaining members 156 are fixed on the rim of the grinding ring seat 152 by screws 157 and extend inwardly to overlie the grinding ring 59. A waste material discharge duct 159 communicates with the lower mill cylinder 15.

Contained in the gear box 60 fixed under the lower mill cylinder 15 is the decelerating means 6. The decelerating means comprises a driving gear 61 fixed at the lower end of the main shaft 2, a driven gear 64 coupled to the lower part of a driven shaft 63 supported at opposite ends by bearings 62 in the gear box 60, a gear 65 coupled coaxially with the drive gear 64 to the upper end of the rotary bushing 52. A spiral pump 67 is mounted under the lower end of the main shaft 2. The gear box 60 contains lubricant which can be delivered by the pump 67 through a channel 28 to the main shaft 2 and each bearing to reduce friction therebetween, and then be returned to the gear box via a return pipe 68. The return pipe 68 is fitted with a transparent inspection tube 69 outside the gear box so as to allow checking of the circulation and amount of the lubricant.

The operation of the invention will be described in detail hereinafter.

The motor M is actuated to cause the main shaft 2 to rotate the exhaust fan 30, classifying means 4 and driving gear 61 which are mounted coaxially on the main shaft. Then the rotating drive gear 61 transmits its rotating motion to the rotary bushing 52 through the driven shaft 63 and gears 64 and 65. While the rotary bushing 52 is caused to rotate at a low speed, the roller seat 53 secured to the rotary bushing 52 will rotate about the main shaft 2 concurrently with the rotating bushing thereby drive each of the grinding rollers 57 supported on the mill shafts 56 fixed on the roller seat 53. Under the influence of centrifugal force the rotating roller shafts 56 and grinding rollers 57 tend to incline outwardly on the hinge shaft 542 to impinge on the grinding ring 59, but the degree of inclination is limited by the adjustable plates 588 such that a small clearance is maintained between the grinding rollers 57 and the grinding ring 59. Since no friction will occur between the grinding rollers and the grinding ring, the grinding roller means can be started easily and quickly without requiring high power.

Figure 13:
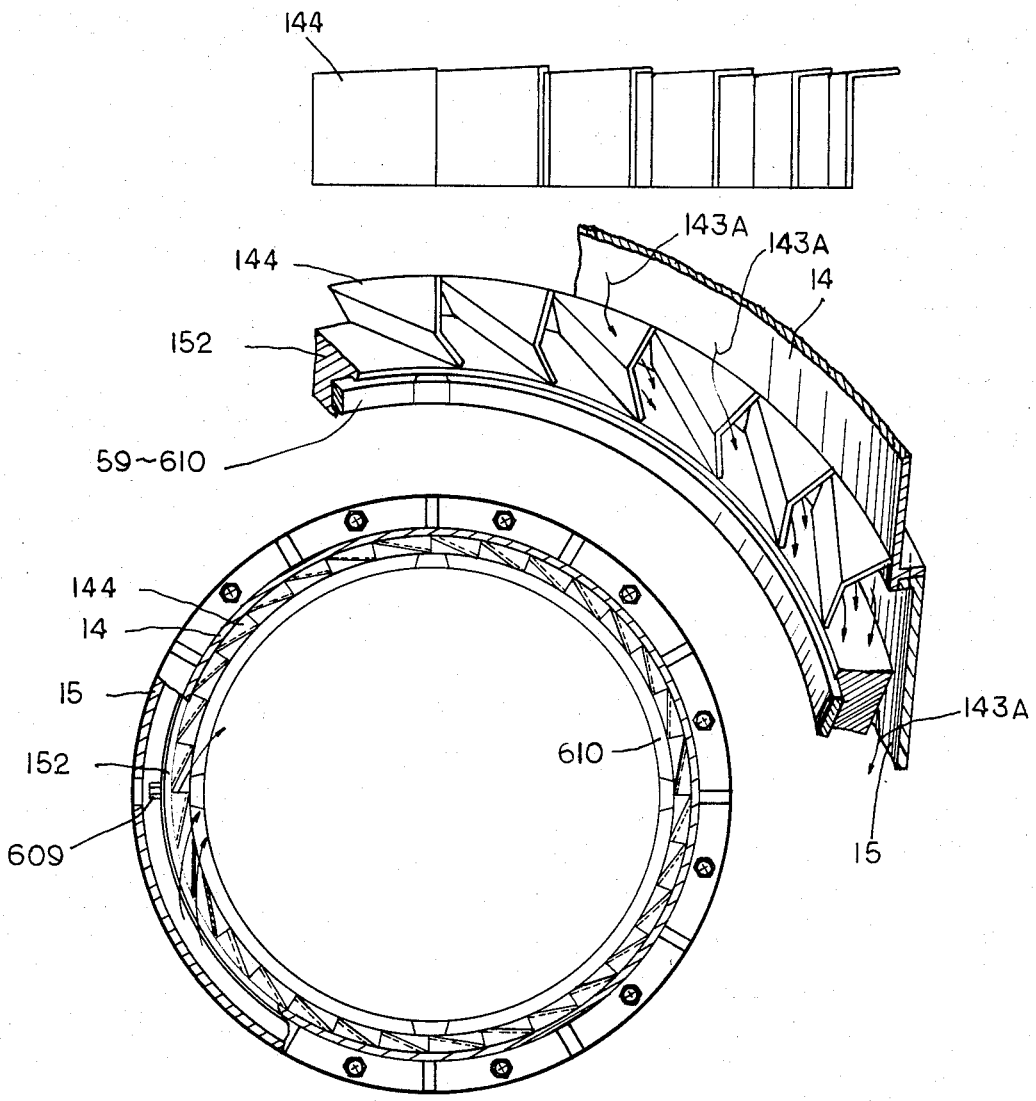
FIG. 13 is a top view in partial section of the grinding ring seat.
Figure 14:
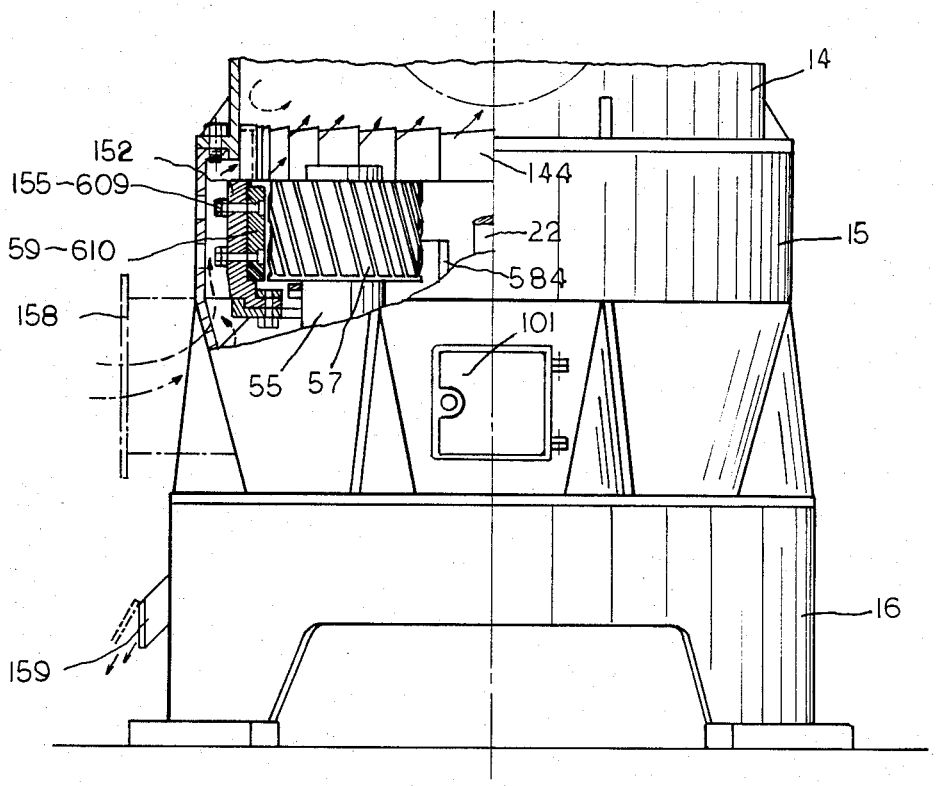
FIG. 14 is a partial cut away view of the lower portion of FIG. 1.

After the grinding roller means is rotated, raw material is fed through the feed inlet 141 into the mill 1 to drop down on the rotating centrifugal device 58, whose centrifugal vanes 584 direct the raw material into the clearance between the inner wall of the ring 59 and the grinding rollers where the raw material is ground into particles by crushing and attrition between the grinding rollers and the ring. The particles are carried in an upwardly spiralling air of stream created from the air inlet pipe 158 by the fan 30 to the classifying means 4 where particles of the desired size are drawn through the finished product inlet 131 into the fan chamber and then are discharged through the exhaust pipe 132 to a cyclone separator not shown in the figures. The coarser and heavier particles are thrown against the inner wall of the central mill cylinder 14 due to the centrifugal force produced by the classifying means 4 without being carried upwardly in the aforesaid upwardly spiralling air stream, and drop down to the grinding zone for further reduction in size. The oversized particles or any material which is hard to grind will fall under the influence of gravity through the space between the grinding ring seat 152 and the lower mill cylinder 15 to the bottom of said lower mill cylinder 15 where a radially extending sweeping board 538 secured to the undersurface of the circular seat portion of the roller seat 53 will sweep such material to the waste material discharge pipe 159. FIG. 14 shows with arrows the downward path of the heavy particles and the upward path of the air flow. It will be seen in FIG. 13 that the arrows emanating from inlet plates 144 show the air flow direction while arrows 143a show the path of coarse particles that are rejected ultimately at discharge duct 159.

In operation the pump 67 under the lower shaft section 23 forces the lubricant in the gear box through the channel 28 into the clearance between the lower shaft section 23 and rotary bushing 52, and then into the clearance between the rotary bushing 52 and the fixed sleeve 51 to lubricate the bearings. Thereafter the lubricant is returned via the return pipe 68 into the box 60 for recirculation. Depending on the desired fineness of the finished particles, the clearance between the grinding ring and rollers can be changed by adjusting the adjustable plate 588 and the number of separate vanes 43 of the classifying means 4 changes. To be more specific, the smaller the aforesaid clearance is the more separate vanes are used, and the finer the finished particles will be; otherwise, the finished particles will be coarser.

Also, depending on the type and nature of the raw material to be ground, the clearance between the grinding ring and rollers can be adjusted to optimize the grinding effect. In case the clearance widens due to wear of the grinding surface of the rollers caused by long periods of use, such a disadvantage can be overcome the adjusting the adjusting screws 536 to adjust the position at which the roller support cylinder is hinged. Moreover, in the event of a loss of power during operation, since the fan 30 stops, the raw material and ground particles left within the mill will drop down on the bottom of the mill and will be swept to the waste material discharge duct 159 by the sweeping board 538 driven by virtue of the inertia of the rotary bushing 52 without plugging between the grinding ring and rollers. Thus as soon as the power supply resumes, the mill can start easily without causing any noise and damage to the motor which requires clearing of the residual raw material and ground particles within the mill cylinder. In addition, in case of wear each grinding roller 57 can be easily and quickly removed for repair or replacement by opening the inspection door 101 and removing the nut 572.

Figure 8:
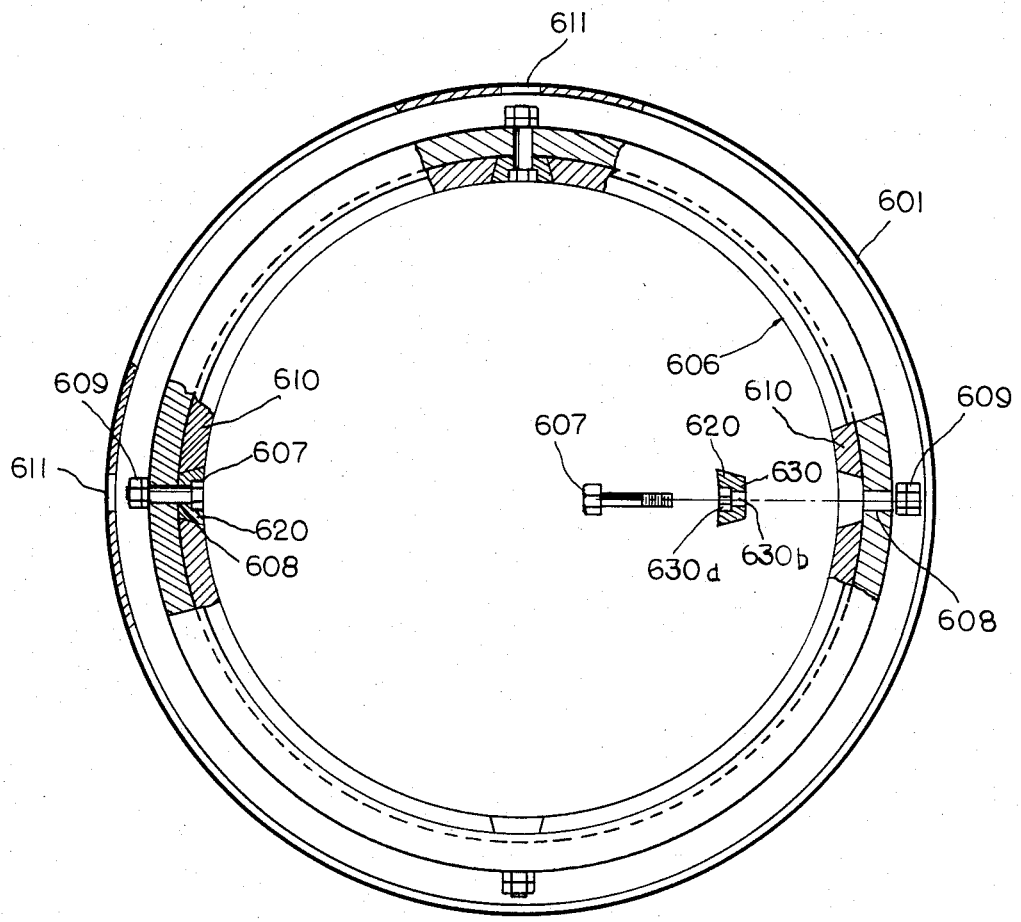
FIG. 8 is a plan view, with a partial exploded view, of the mill cylinder of the present invention.
Figure 10:
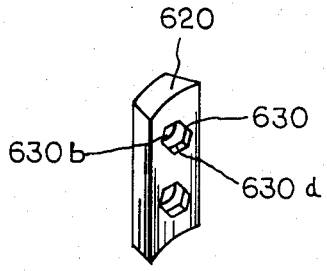
FIG. 10 is a perspective view of the wedge-shaped fixing block in said grinding ring of the present invention.
Figure 9:
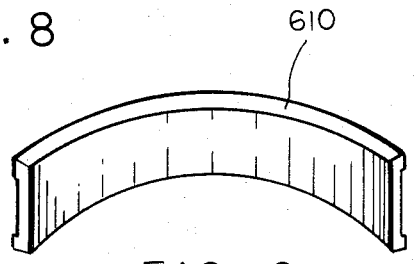
FIG. 9 is a perspective view of the arc-shaped grinding ring piece in said mill cylinder.
Figure 11:
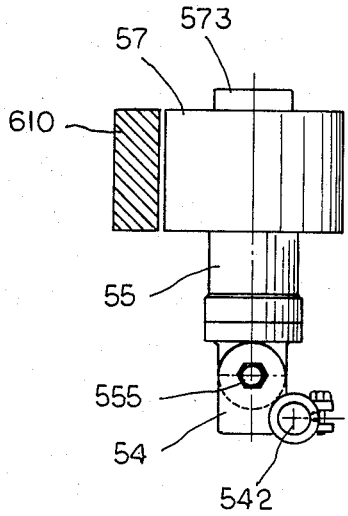
FIG. 11 is a schematic view showing a wearing compensation mechanism before the occurrence of wearing.
Figure 12:
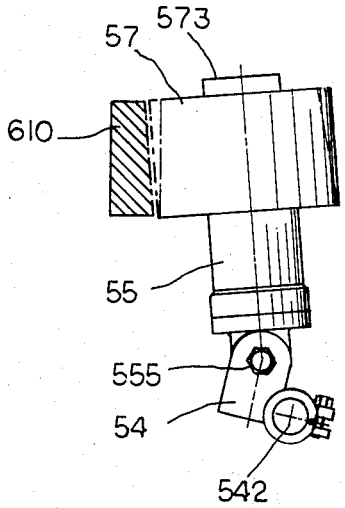
FIG. 12 is similar to FIG. 11 but showing the mechanism after the occurrence of wearing and the adjustment to compensate for wearing.

In addition, the grinding ring 59 may also be replaced with another embodiment of a grinding ring assembly 606 as shown in FIGS. 8 to 10. The assembly 606 includes a number of arc shaped grinding ring pieces 610 (in the present embodiment, there are four pieces), and an equal number of wedge-shaped fixing blocks 620, being disposed in an alternate manner so as to form an annular ring liner in the mill cylinder 601. Each of the wedge shaped fixing block 620 is formed into an arc, and is furnished with two hexagonal nut seats 630*a* at its inner surface, and furnished with two round holes 630*b* at its outer surface. The hexagonal head of the screw 607 is to be fitted into the hexagonal nut seat 630*a*, while the screw 607 passes thru the round hole 630*b*, and the grinding ring seat 605 and protrudes in a space between the mill cylinder 601 and the grinding ring seat 605. Then, the screw 607 is fixed and locked in position with two nuts 609. Preferably, the thickness of the wedge-shaped fixing block 620 is slightly less than that of the arc-shaped grinding ring piece 610. In principle, the head portion of the screw 607 must not protrude out of the surface of the arc-shaped grinding ring piece 610 upon the screw 607 which is screwed into the hexagonal nut seat 630*a*. The advantages of this embdoiment are: first, to save manpower and time during assembling; for instance, when assembling a conventional mill cylinder, two persons are required at least. For assembling this embodiment, only one person is necessary; in addition there is no chance of generating noise and becoming loose after extended operation because of the effects of wedge-shaped fixing block 620 and the centrifugal force during rotation;

FIG. 11 and 12 show a mechanism for compensating for wear between the grinding rollers 57 and the arc-shaped grinding ring piece 610. A hinge shaft 555 which is a screw per se is inserted into the grinding roller support cylinder 54 and the lower end of the bearing sleeve 55 so that the bearing sleeve 55 can be tilted toward the arc-shaped grinding ring piece 610 or away from it. After a period of using the arc-shaped grinding ring piece 610 and the grinding rollers 57 are worn. The grinding rollers 57, the fixing nut 573, and the bearing sleeve 55 can be moved toward the arc-shaped grinding ring piece 610 so as to compensate for wear. Thereafter, the hinged screw 555 is tightened so as to fasten the said parts on the grinding roller support cylinder 54. Thus the wearing can be compensated.

Air is introduced because of the suction force of the exhaust fan 30 through a gap between a grinding ring seat 152 and grinding ring 15 (see FIG. 13), and enters into a ring 14 via tangential air inlet plates 144 so that powder material can be separated with a separator 4. The powder material or impurity which is relatively large or heavy will not ascend with the air flow and will lose centrifugal force and will then drop along an inner peripheral wall of the ring 14 and will fall through the tangential air inlet plates 144 in the grinding means 5 and be ground again. However, the powder material which is overcharged into the machine or the impurity or remainder which is too hard to grind will fall through the gap between the grinding ring seat 152 and the grinding ring 15 onto a sweeping plate 538 on the lower part and will be discharged through a remainder discharge exit 159.

With the above advantages and reasonable designs, the invention is of great industrial value.

Although the present invention has been described in connection with a preferred embodiment thereof, it will be appreciated by those skilled in the art that modifications and changes may be made without departing from the spirit and scope of the invention as defined in the appended claims.

We claim:

1. A grinding mill comprising a mill cylinder, a vertically mounted main shaft coupled at the upper end to a motor mounted atop the mill cylinder to be driven thereby and extending along the axis of the mill cylinder, and means mounted in descending order on the main shaft including a finished product conveying means, a classifying means, a grinding roller means and a decelerating means, a fixed sleeve fixed on the bottom of the mill cylinder to support a rotary bushing by means of bearings, a centrifugal device fixed to the upper end of the rotary bushing, a roller seat fixed likewise to the upper end of the rotary bushing and extending downwardly and radially, a plurality of roller shafts hinged at the lower end to the roller seat so as to pivot relative to the axis of the rotary bushing, and a corresponding plurality of grinding rollers detachably mounted on the upper end of each roller shaft.

2. A grinding mill as defined in claim 1, wherein said centrifugal device is located below the grinding rollers and has a circular plate formed with circumferentially spaced semicircular openings for receiving said roller shafts, each semicircular portion being provided with an adjustable plate having a corresponding opening and adapted to be radially adjusted in position to limit the angle of inclination of each roller shaft.

3. A grinding mill as defined in claim 2, wherein said centrifugal device is further provided with a plurality of curved centrifugal vanes thereon and an inclined scraper extending downwardly from the outer end of each centrifugal vane.

4. A grinding mill as defined in claim 1, wherein said roller seat is loosely fitted around the fixed sleeve and has a circular seat portion on which said roller shafts are pivotally supported by hinge members which are radially adjustable.

5. A grinding mill as defined in claim 4, wherein said roller seat is further provided with a radially extending sweeping board secured to the undersurface of the circular seat portion of the roller seat for removing waste material.

6. A grinding mill as defined in claim 1, wherein a plurality of circumferentially and evenly spaced support plates are provided on the inner wall of the mill cylinder which faces the grinding roller means, and an annular grinding seat is secured to said support plates and spaced apart from the inner wall of the mill cylinder to allow the passage of air, said annular grinding seat having an annular grinding ring attached thereto around the said grinding roller means.

7. A grinding mill as defined in claim 1, wherein a spiral pump is mounted at the lower end of the main shaft for forcing a lubricant through a channel in the lower end of the main shaft to the clearance between the main shaft and the rotary bushing and the fixed sleeve, and returning the lubricant via a return pipe extending from the lower end of the fixed sleeve to a gear box for the decelerating means for recirculation.

8. A grinding mill as defined in claim 7, wherein said return pipe is fitted with a transparent inspection tube for checking the circulation and amount of the lubricant.

9. A grinding mill as defined in claim 1, wherein said classifying means comprises a double-disc rotary member coupled to the main shaft and a plurality of separate blades removably attached in vertical position to the double-disc rotary grooves.

10. A grinding mill as defined in claim 1, wherein said grinding roller is formed in its grinding surface with evenly spaced swerving corrugated, or spiral grooves.

11. A pulverizing mill as defined in claim 1, wherein said grinding ring may comprise a given number of arc-shaped grinding ring pieces, an equal number of wedge-shaped fixing blocks; all of whch being disposed in an alternate manner so as to form an annular ring liner in said mill cylinder; and each of said wedge-shaped fixing blocks having a slight arc and being fitted in position with a screw; the thickness of the wedge-shaped fixing block being slightly less than that of the arc-shaped grinding ring piece.

12. A pulverizing mill as defined in claim 1, wherein a mechanism for compensating the wearing between the grinding rollers on an arc-shaped grinding rign piece is provided for the grinding rollers, said mechanism including a hinge shaft inserted into a grinding rollers support cylinder and a lower end of a bearing sleeve under the grinding rollers so that the bearing sleeve can be tilted toward or away from the arc shaped grinding ring piece.

13. A pulverizing machine as in claim 1, wherein a gap is formed between the grinding ring seat and the grinding ring so that the air can be introduced through the gap into the machine and the impurity can fall through the gap to an exit.

14. A pulverizing machine as in claim 1, wherein a plurality of tangential air inlet plates are provided inside of the ring and are in the shape of ratchet when viewed from a position right over the tangential air inlet plates so as to result in an eddy current of air flow when the air flow is introduced into the machine and thus facilitate the separation of the powder material.

15. A pulverizing machine as in claim 1, wherein a plurality of tangential air inlet plates are provided inside of the cylinder for preventing the powder material or impurity which is relatively large or heavy from being fallen into the lower part of the cylinder and for introducing the same into the grinding means so that the same can be ground again.

16. A pulverizing machine as in claim 1, wherein a plurality of tangential air inlet plates are provided inside of the cylinder for automatically discharging the powder material which has been overcharged into the machine or the impurity or remainder which is too hard to grind.

* * * * *